US005341605A

United States Patent [19]

Tasikas

[11] Patent Number: 5,341,605

[45] **Date of Patent: * Aug. 30, 1994**

[54] DUAL MODE FLOOR SANDER

[76] Inventor: James Tasikas, 128 Krieghoff Avenue, Markham, Ontario, Canada, L3R 1V9

[ * ] Notice: The portion of the term of this patent subsequent to Jul. 6, 2010 has been disclaimed.

[21] Appl. No.: 44,497

[22] Filed: Apr. 9, 1993

Related U.S. Application Data

[63] Continuation-in-part of Ser. No. 854,579, Mar. 20, 1992, Pat. No. 5,224,301.

[51] Int. Cl.[5] ..... B24B 23/00

[52] U.S. Cl. ..... 51/174; 51/170 T; 51/170 EB; 51/181 R

[58] Field of Search ..... 51/170 R, 170 EB, 174, 51/181 R, 170 T

[56] References Cited

U.S. PATENT DOCUMENTS

| | | | |
|---|---|---|---|
| D. 293,763 | 1/1988 | Arehart . | |
| 2,431,613 | 11/1947 | Hedemark | 51/176 |
| 2,596,689 | 5/1952 | Holt | 51/176 |
| 2,598,080 | 5/1952 | Swalinkavich, Jr. | 51/174 |
| 2,621,350 | 12/1952 | Bye . | |
| 2,655,770 | 10/1953 | Parovel | 51/174 |
| 2,752,736 | 7/1956 | Ballard | 51/176 |
| 2,780,897 | 2/1957 | Radase . | |
| 3,488,889 | 1/1970 | McCay . | |
| 4,335,542 | 6/1982 | Howe . | |

OTHER PUBLICATIONS

Galaxy 506 Floor Sander brochure.
Galaxy News.

*Primary Examiner*—Roscoe V. Parker

[57] ABSTRACT

A dual mode floor sander and having a housing with a front wall, back and side walls, a handle extending upwardly a sanding drum mounted in the housing, and a drive motor, a strip clamp on the drum for clamping a strip of abrasive material for use in the drum sanding mode, a belt tension roller located spaced from the sanding drum, a movable tension assembly associated with the tension roller, for moving the tension roller relative to the sanding drum, so that a belt of abrasive material placed around the sanding drum and tension roller may be placed in tension, and doors in the housing giving access to the sanding drum and to the tension roller.

12 Claims, 7 Drawing Sheets

DUAL MODE FLOOR SANDER

This application is a continuation-in-part of U.S. application Ser. No. 07/854,579, filed Mar. 20, 1992 and now U.S. Pat. No. 5,224,301.

FIELD OF THE INVENTION

The invention relates to sanders for hardwood floors and in particular, to a dual mode sander which is convertible from drum sanding, to belt sanding.

BACKGROUND OF THE INVENTION

In the installation of, or renovation of, hardwood flooring, the surface of hardwood floors must be sanded. Sanding is usually carried out with one of two types of pieces of equipment. The simplest form of equipment is the so-called drum sander. This piece of equipment comprises a cylindrical drum, around which a strip of abrasive material is secured. A motor rotates the drum. The drum is moved around the hardwood floor surface, and sands it smooth.

This type of equipment is reasonably economic to operate and is economical in its consumption of abrasive paper. However, the quality of surface finish is somewhat impaired. This is due to the gap at each end of the strip.

The other form of equipment which is used for this purpose is a so-called belt sander. In this type of equipment, a drum is provided, and adjacent the drum a tension roller is provided. The abrasive material consists of an endless belt of abrasive material. The belt is arranged around the drum and the tension roller. The drum is then rotated by a motor, thus causing the belt to abrade the hardwood surface. The type of equipment produces a higher quality surface finish in use. However, it also consumes more expensive materials, since the endless belts are much more expensive than simple strips of abrasive material used on drum type sanders. As a result, belt sanders are used principally for the final or finish sanding of the floor after the drum sander has been used.

In the past, flooring installers and service persons have usually been obliged to purchase both belt sanders and drum sanders. This enabled them to carry out both forms of operation at whatever locations were required. However, there are various disadvantages to this practice. In the first place the flooring installer must purchase two relatively expensive pieces of equipment, or possibly more than two, depending on the size of the operation. If one or other of the machines becomes unserviceable, then he is only capable of carrying out one operation, but not the other. Similarly, in a larger operation, where a company may have several pieces of both equipment, they must usually send out both a belt sander and a drum sander to the same job site.

If one or other of these pieces of equipment breaks down, then there is of course down time on that particular job, until the piece of equipment has been repaired.

It is desirable to provide a single piece of equipment, which can be used for both belt sanding and drum sanding alternatively. In this way, flooring installers and servicemen may buy perhaps only two or three pieces of equipment, or more, depending on the size of the operation. They are then completely flexible to carry out both functions, one after the other or in different locations where desired. When a piece of equipment breaks down, then it can be easily replaced by another piece of the same equipment. There will then be substantial savings in capital investment to these operators and service people and at the same time, they will be able to provide their service in a more efficient and expeditious manner than with two different pieces of equipment described above.

BRIEF SUMMARY OF THE INVENTION

With the view to overcoming these various disadvantages described in relation to prior art equipment, the invention comprises a dual mode floor sander and comprising, housing means defining a front wall, back and side walls, a handle extending upwardly from said housing means whereby the same may be moved and guided on the surface, a sanding drum mounted in said housing means adjacent a forward area thereof, and power operated means for rotating the same, strip clamping means on the said drum for clamping a strip of abrasive material therearound, for use in the drum sanding mode, a belt tension roller located in spaced relation to said sanding drum, movement means for moving said belt tension roller relative to said sanding drum, tension means associated with the said tension roller, operable whereby a belt of abrasive material placed around the sanding drum and said tension roller may be placed in tension, and door means in said housing means for giving access to said sanding drum and said tension roller.

The invention further comprises such a floor sander and wherein said tension roller comprises roller means movably mounted relative to said sanding drum, and biassing means operable to urge said tension roller away from said sanding drum, whereby to apply tension to a belt placed therearound.

The invention further comprises such a floor sander wherein said tension roller further comprises pressure means operable on said tension roller, whereby to force said tension roller against said biassing means towards said sanding drum, thereby permitting removal and replacement of said sanding belt thereon.

The invention further comprises such a floor sander and further including a tension roller mounting bracket, having bearing supporting means at each end for supporting opposite ends of said tension roller, mounting abutment means intermediate said two ends of said bracket, mounting arm means engageable with said mounting abutment means, said mounting arm means defining a free end engageable with said abutment means, and said mounting arm further defining arm mounting means, whereby said arm may be movably mounted to an inside portion of said housing, whereby said mounting arm and said bracket means and said tension roller are together moveable relative to said sanding drum.

The invention further comprises such a floor sander and including rotatable belt guide members mounted on said bracket means at either end thereof, adjacent opposite ends of said tension roller, whereby to guide said belt passing over said tension roller.

The invention further comprises, in one embodiment of the invention, such a floor sander, wherein said arm mounting means comprises a slidable block member, mounted to one side of said housing, and slidable along a linear path away from and towards said sanding drum.

The invention further comprises such a floor sander, and wherein said bearing mounting means on opposite ends of said arm means include at least one spring loaded bearing mounting means, and adjustment means therefore, whereby said tension roller may be tilted relative to said belt sander, for adjustment of a belt thereon.

The invention further comprises such a floor sander and wherein said mounting arm member is pivotally mounted to said side housing, and is both slidable towards and away from said sanding drum, and is further swingable, whereby to procure tilting of said mounting arm means and said tension roller relative to said sanding drum.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
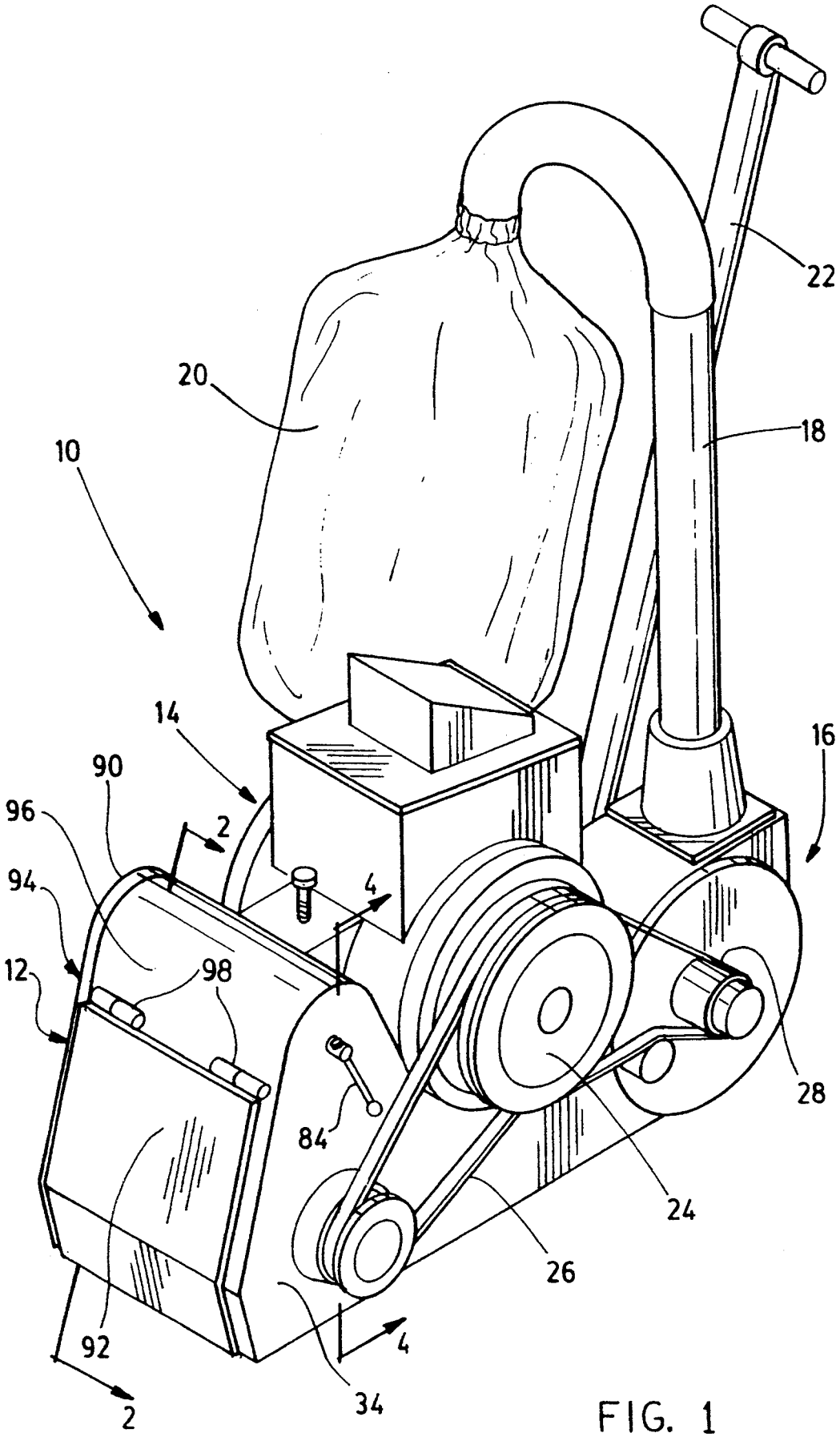
FIG. 1 is a perspective illustration showing a dual mode floor sander in accordance with the invention.

Referring first of all to FIG. 1, it will be seen that the sander is there illustrated by the general reference arrow 10. It will be seen to comprise a drum housing 12, a motor housing 14, and a vacuum housing 16. A vacuum hose 18 and bag 20 are typically provided, for collecting dust. The entire apparatus is controlled by means of a handle 22, and suitable on/off controls will be provided (not shown).

The motor (not shown) within housing 14 drives a two element pulley 24. Two belts 26 and 28 respectively drive the sanding drum and the vacuum for (not shown) in housing 16.

Figure 2:
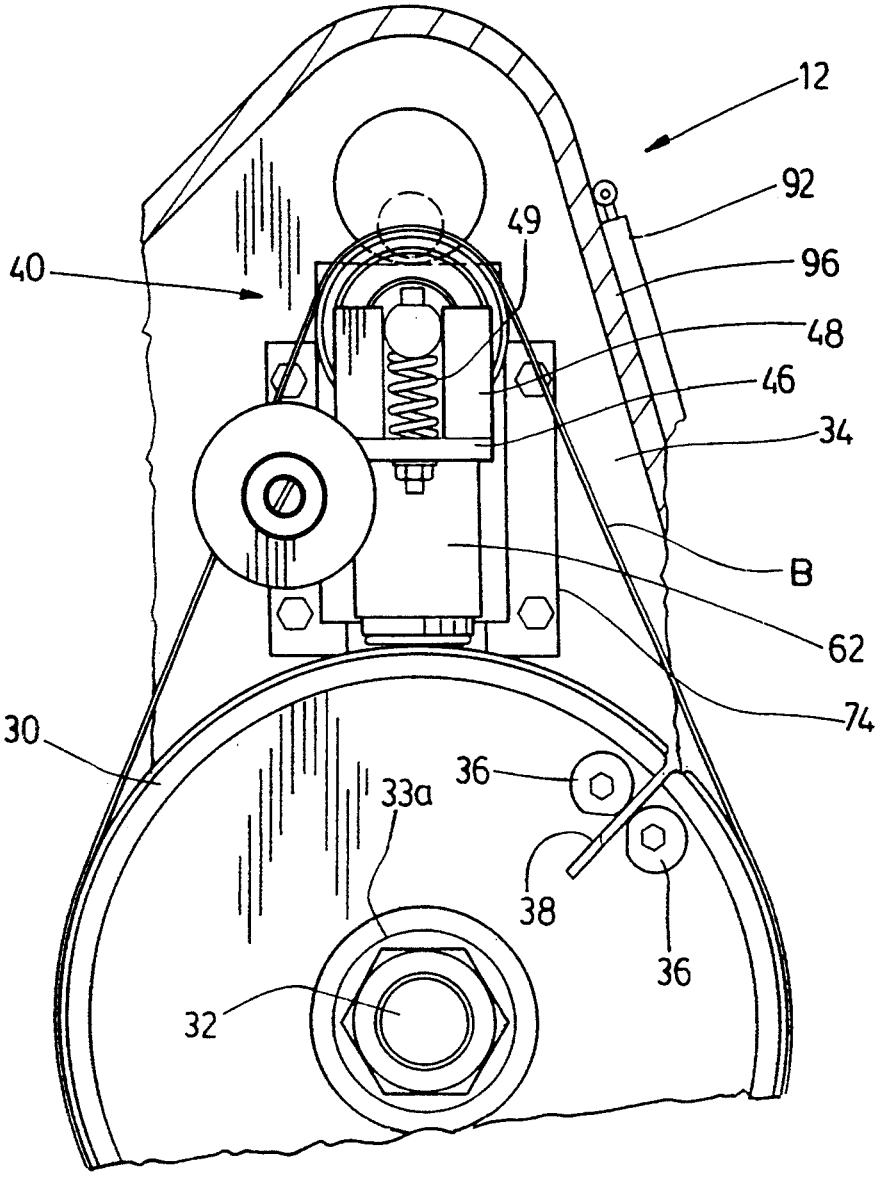
FIG. 2 is a section along the line 2—2 of FIG. 1.
Figure 3:
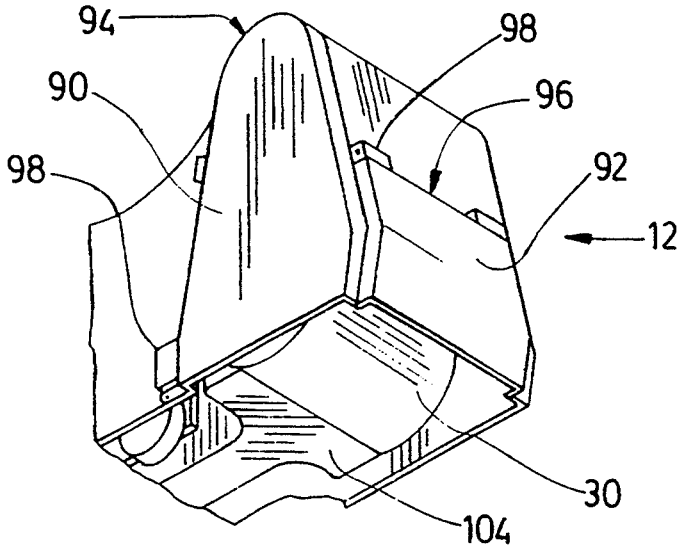
FIG. 3 is a perspective illustration of the housing portion, showing two door portions removed therefrom.

Referring now to FIG. 2, it will be seen that the drum housing 12 contains a sanding drum 30, mounted on a central axle 32. The axle 32 is rotatably mounted in suitable bearings 33, in sleeve **33*a* extending from the side wall 34 of housing 12**.

Figure 6:
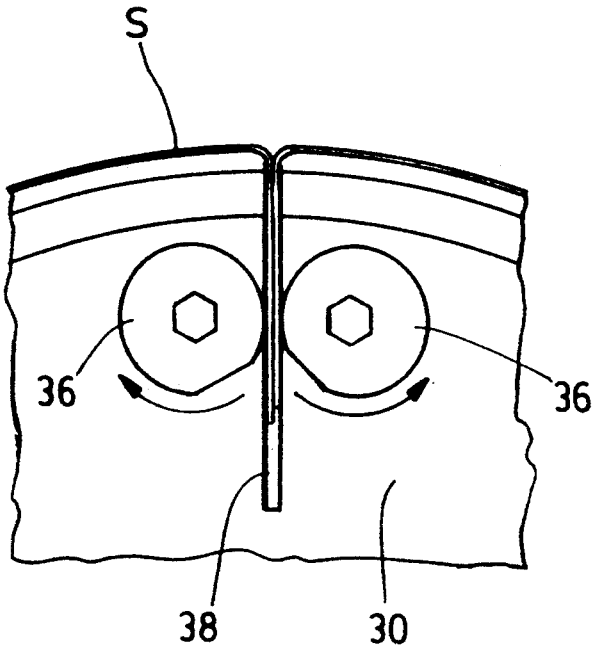
FIG. 6 is an enlarged side elevation of a portion of the sanding drum.
Figure 7:
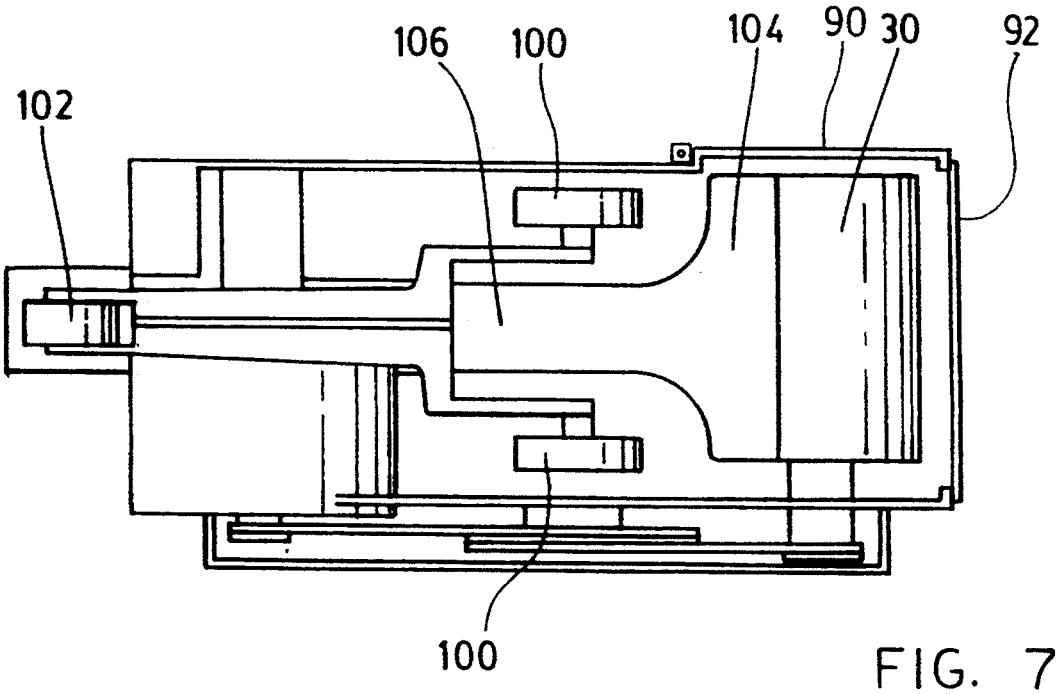
FIG. 7 is a lower plan view of the sander of FIG. 1.

The sanding drum has clamping means, for clamping a sheet of abrasive material thereto. Such clamping means comprise a pair of rotatable clamping rollers 36—36, mounted on either side of a slot 38. By a suitable tool, such as a wrench or allen key, the two rollers may be rotated (FIG. 6) so as to clamp the two free ends of a sheet S of sanding paper.

Thus, the dual mode sander, according to the invention may be used in the drum sanding mode.

In order to permit it to be also used in the belt sanding mode, a belt tension roller assembly indicated generally as 40 is provided.

Figure 4:
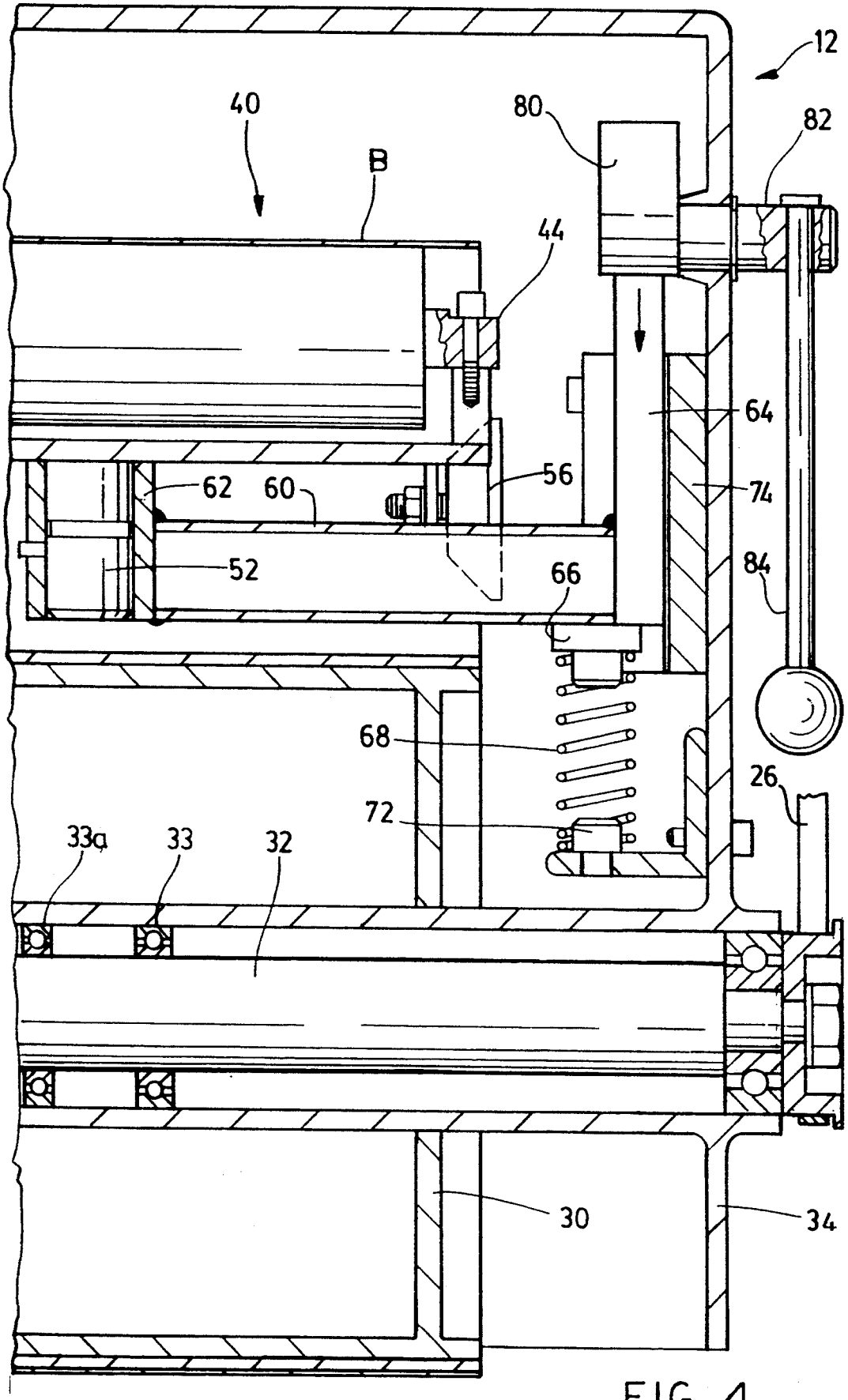
FIG. 4 is a section along the line 4—4 of FIG. 1.
Figure 5:
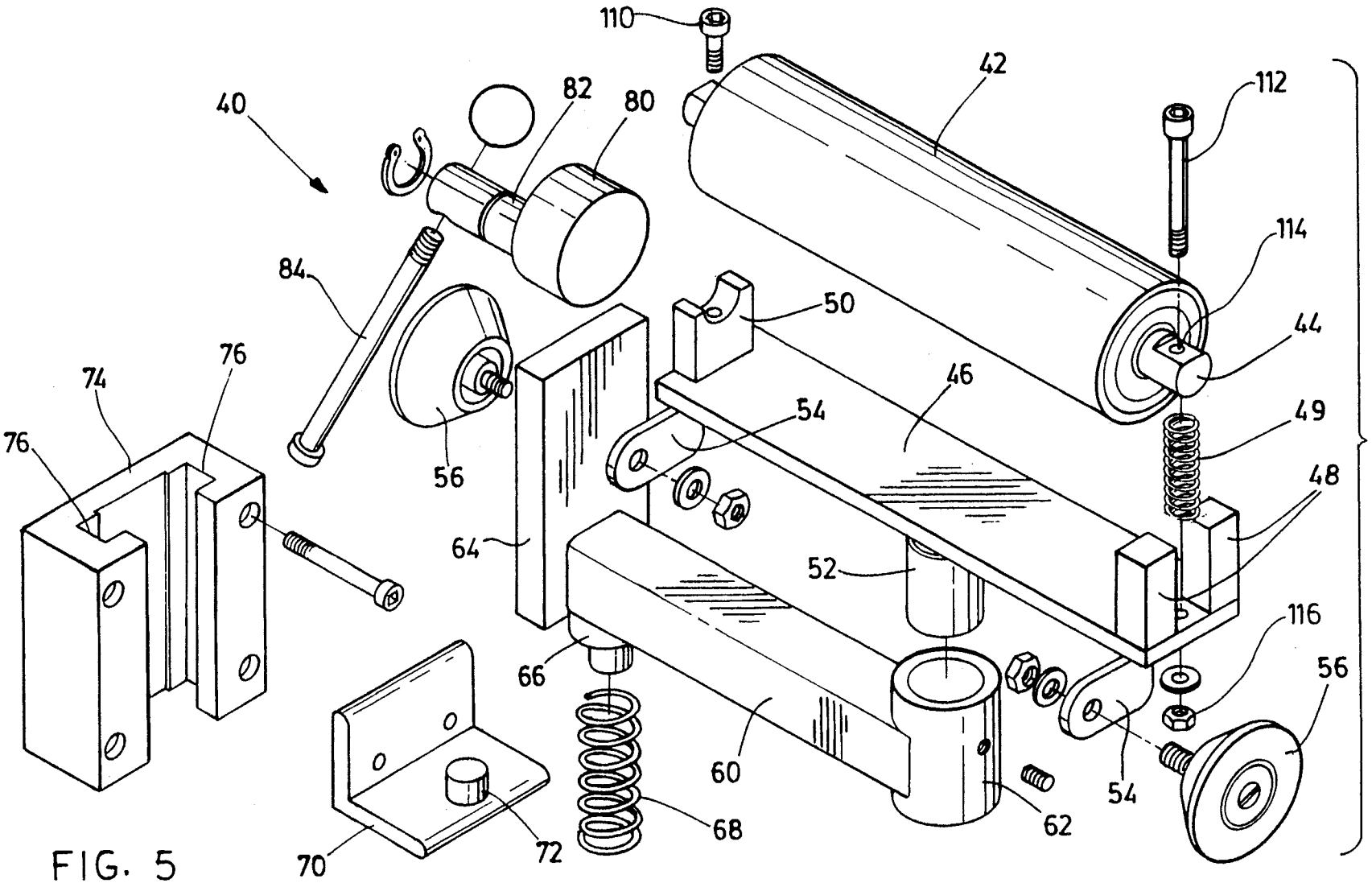
FIG. 5 is an exploded perspective illustration, showing the tension roller and adjustment means.

The tension roller assembly is shown in more detail in FIGS. 4 and 5. It will be seen to comprise a roller 42 rotatably mounted on a axle 44. Axle 44 is in turn mounted on a support frame 46. Frame 46 is provided with a yoke 48 consisting of two substantially vertical columns and a spring 49, at one end. At the other end, a semi-circular support block 50 is provided.

The support frame is provided with a central mounting column 52, and two support flanges 54—54. Flanges 54—54 carry belt guides 56—56 for purposes to be described below.

The entire frame 46 is in turn supported on a cantilever arm 60. Arm 60 has a cylindrical sleeve 62 mounted substantially perpendicularly at its free end. At its other end, it has a relatively massive slide plate 64 secured thereto.

A boss 66 is secured to the underside of the arm 60 adjacent the plate 64. A compression spring 68 is captured between the boss 66, and a pressure plate 70, also provided with a boss 72.

Pressure plate 70 is secured and bolted to the side wall 34 of housing 12 (FIG. 4).

In this way, the compression spring 68 urges the cantilever arm 60 upwardly, for purposes to be described below.

In order to permit sliding of the block 64, a guide shoe 74 is provided, which is also bolted to the side wall 34 (FIG. 4).

It is provided with guide grooves 76—76, adapted to make a snug sliding fit around the two free edges of the block 64.

In order to move the block 64 and arm 60 downwardly and therefore compress the spring 68 still further, a cam 80 is provided, mounted on a shaft 82. Shaft 82 extends through side wall 34, wherein it is rotatably secured. Arm 84 is passed through shaft 82, and is located outside the housing 12.

Thus by operating the arm 84, the cam 80 can be rotated. The cam 80 contacts the upper edge of the block 64 (FIG. 4). In this way, the entire tension assembly 40 can then be lowered i.e. moved towards the sanding drum, or released, in which case the compression spring 68 will urge the tension roller away from the sanding drum.

All of this mechanism is located adjacent the wall 34 of the housing 12. Thus the end of the tension roller 42 remote from the wall 34, is freed from any mechanism. In this way it is possible to slide a belt B of abrasive material over both the roller 42, and also over the sanding drum 30.

In order to give access to the interior of the housing 12, two doors are provided. These comprise the side door 90, and the front door 92, located respectively in the side 94 of housing 12, opposite to side 34, and on the front wall 96.

Preferably, in accordance with the invention, the doors are mounted on respective hinges 98, and 100. Hinges 98 and 100 are of the single ended type, so that once the doors are swung open, they may be slid off their respective hinges, thereby enabling the operator to put the doors on one side.

In this way, the operator has access to the side of the machine, for placement and replacement of the belts B, which must be slid on from the free ends of the roller 42 and drum 30, and also has access to the front of the machine as well as the side, for wrapping a strip S of sandpaper around the sanding drum 30.

In order to support the machine on the floor, two front rollers 101—101 are provided, beneath the motor housing 14. One of rollers 101 is adjustable in a manner well known in the art, to level the drum. A third single support wheel 102 is provided beneath the vacuum housing 16, adjacent the lower end of the handle 22. The wheel 102 is connected to the lower end of the handle 22, so that the operator can more easily guide the machine and steer it, by swinging the rear wheel 102 from side to side.

In addition, a dust catcher blade 104 is provided adjacent the sanding drum 30, connected by a duct 106 to the vacuum housing 16. In this way, as the drum rotates, dust will be sucked up by the dust catcher, and collected in the bag 20.

In the embodiment of FIGS. 1 through 7, the tension roller 42 is secured to the mounting bracket 46 by means of the axle 44 extending therethrough.

At the housing end of the axle 44, a bolt 110 passes through the end of axle 44, and is secured in bearing block 50.

At the other end of axle 44, a mounting bolt 112 passes through opening 114 in axle 44, through captive spring 49, and through bracket 46, and is secured by means of nut 116.

The two sides of the axle 44 are held from lateral movement by the two posts 48—48 on bracket 46.

The spring 49 is a compression spring which is relatively strong. Consequently, by adjusting the bolt 112, the roller 42 may be tilted relative to the axis of the sanding drum 30. This may be necessary from time-to-time in order to ensure that a sanding belt is tensioned evenly across the sanding drum 30.

Figure 8:
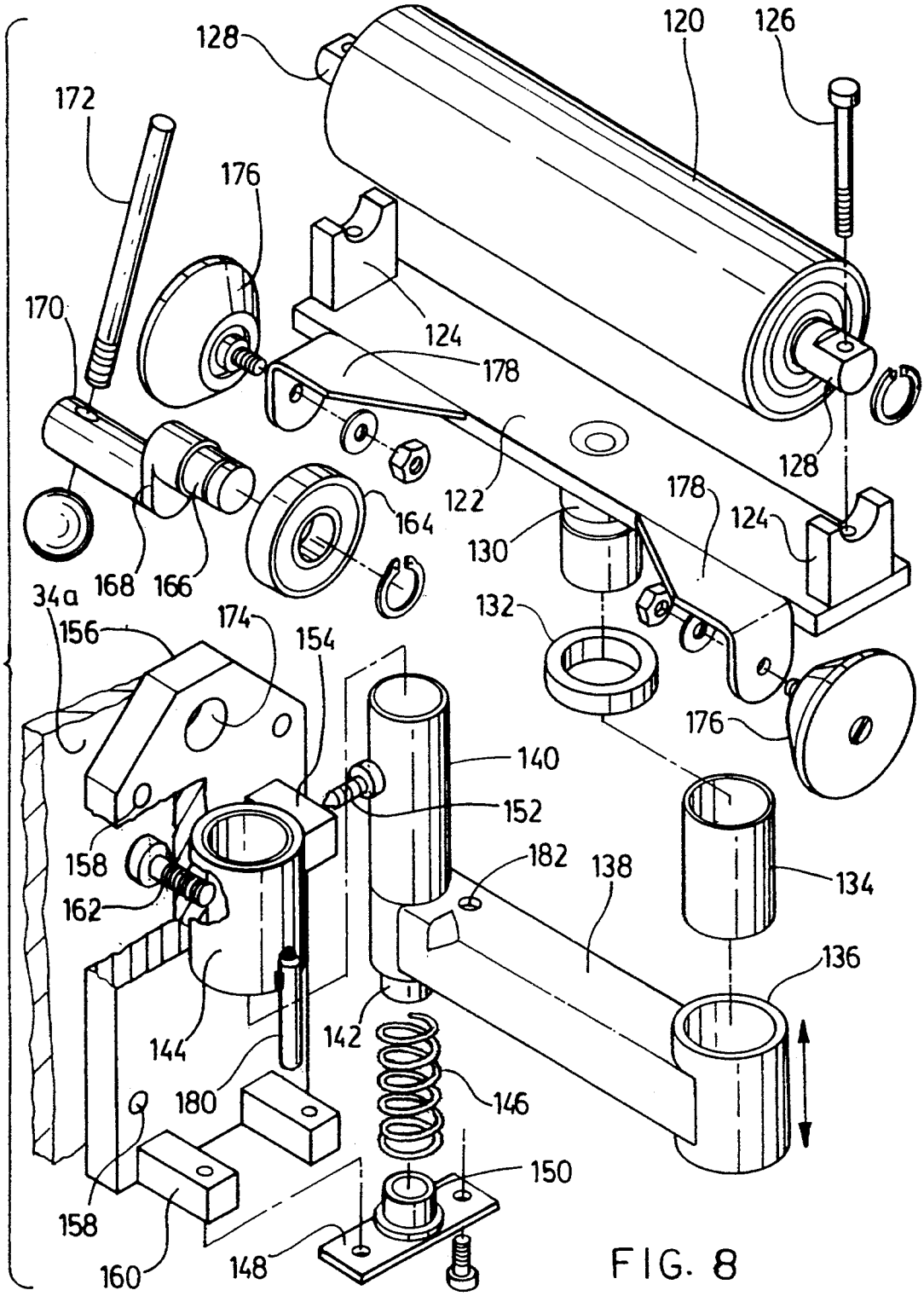
FIG. 8 is an exploded perspective illustration of a further embodiment of the invention with parts cut away thereof.
Figure 9:
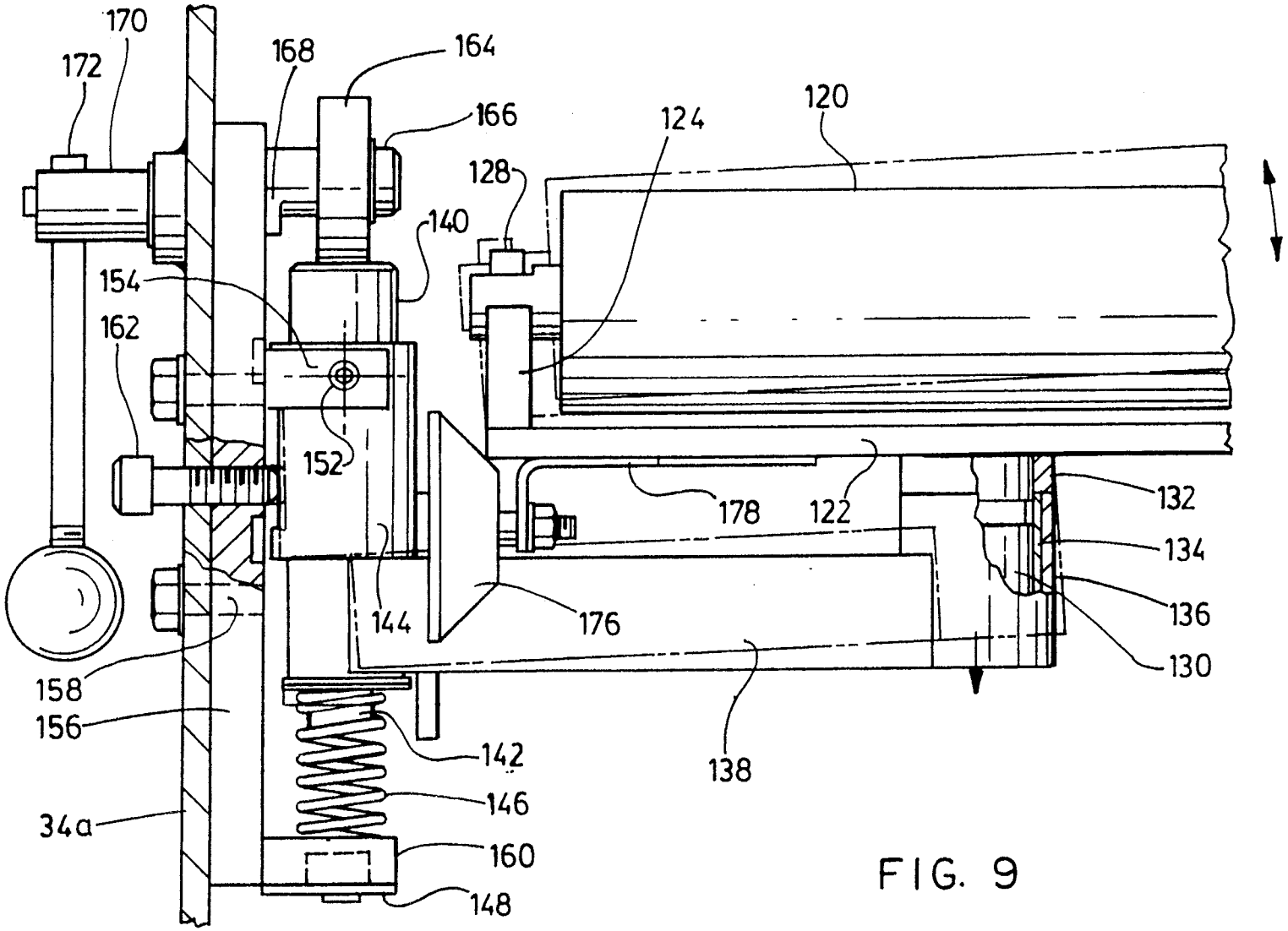
FIG. 9 is a section along the line 9—9 of a portion of the embodiment of FIG. 8.

In accordance with a further embodiment of the invention illustrated in FIGS. 8 and 9, this tilting adjustment of the roller can be achieved in a somewhat simplified fashion.

In this embodiment of the invention, the side wall of the housing, corresponding to housing wall 34 is indicated as **34*a***.

The remaining components are given new reference numerals for the sake of clarity.

It will be appreciated that the sanding drum, and doors, and the like, of the housing 34 will be substantially identical in this embodiment, and are therefore omitted for the sake of clarity. The only substantial difference in this embodiment is the fact that the tension roller is mounted in a somewhat different manner and is tiltable in a manner different from that shown in the embodiment of FIGS. 1 through 7.

As shown in FIG. 8, a tension roller 120, supported on a mounting bracket 122, by means of bearing mounts 124—124 which are identical at each end. Bolts 126 (only one of which is shown) pass through the free ends of axle 128, securing the axle 128 at its two free ends, to the blocks 124.

Intermediate the two ends of the bracket 122, a mounting column 130 extends downwardly. Column 130, has a bearing ring 132 and a sleeve 134. The sleeve 134 and the column 130 are received in a cylindrical recess 136. Recess 136 is mounted at the free end of a cantilever arm 138. The opposite end of arm 138 is provided with an elongated cylindrical sliding body 140 extending upwardly therefrom, and extending downwardly therefrom, a spring retention boss 142.

Sliding body 140 is received in a cylindrical bearing sleeve 144, and is slidable upwardly and downwardly against the pressure of a spring 146. Spring 146 is retained by means of retention plate 148 embossed 150.

Sleeve 144 is pivotally mounted, by two pivot bolts 152—152 (only one is shown) which in turn pass through arms 154—154. Arms 154—154 are secured to a mounting plate 156. Mounting plate 156 is bolted to the interior service of the side wall **34*a* of the housing, by any suitable bolts (not shown) passing through holes 158**.

Further arms 160—160 are secured to the lower end of plate 156 for supporting the plate 148 and spring 146.

The sleeve 144 is swingable, through a relatively modest arc, on pivot bolts 152—152. In order to procure adjustable swinging movement of the sleeve 144, an adjustment bolt 162, is provided. Bolt 162 passes through a threaded bore in plate 156, and engages the lower end of the sleeve 144. Rotation of the bolt 162 in one direction will cause the lower end of the sleeve 144 to swing outwardly away from the plate 156, and rotation of the screw in the reverse direction will permit it to swing back again.

This will in turn cause tilting movement of the arm 138, and thereby cause corresponding tilting movement of the roller 120.

Bolt 162 extends through a suitable opening 164 in the housing wall **34*a***, so that it is accessible from the exterior of the machine.

This then permits an operator to first of all place a belt in position on the sanding drum and the tension roller, and then to check the tension of the belt and to make sure that it is even across the width of the sanding drum. Any adjustment can then be readily made by operating the bolt 162 from the exterior of the machine.

In order to procure movement of the tension roller 120 towards and away from the sanding drum, for fitting a new belt on, or for removing a used belt, the cylindrical body 140 is slidable within the sleeve 144 against the pressure of spring 146 as described above.

This sliding movement is achieved by means of the roller cam 164 mounted on crank pin 166. Crank pin 166 is in turn mounted on a crank arm 168, the opposite end of which is mounted to the rotatable rod 170. An operating arm 172 passes through the free end of the rod 170 on the exterior of the machine, so as to permit an operator to rotate rod 170, thereby forcing the cam wheel 164 against the top of the cylindrical body 140 and forcing the cylindrical body 140 downwardly against the spring 146.

It will be appreciated that rod 170 passes through a suitable bearing opening 174 in plate 156, and through a corresponding opening in the side wall **34*a*** (not shown).

In order to guide the belt as it passes around the tension roller 122, guide rollers 176 are provided on brackets 178, at opposite ends of the bracket 122, so as to maintain the belt stable on the roller 120.

A guide pin 180 is welded to sleeve 144, and slides in hole 182 in arm 138, to prevent lateral rotation of boss 140 in sleeve 144.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dual mode floor sander adapted for use in a drum sanding, and in a belt sanding, mode and comprising;

housing means defining a front wall, back and side walls, and means whereby the same may be guided;

a sanding drum mounted in said housing means, adjacent a forward area thereof, and power operated means therefor;

strip clamping means on said drum for clamping a strip of abrasive material therearound, for use in said drum sanding mode;

a belt tension roller located in spaced relation to said sanding drum;

movement means for moving said tension roller relative to said sanding drum;

tension means associated with said tension roller, for tensioning said roller relative to said sanding drum, whereby a belt of abrasive material placed around said sanding drum and tension roller may be placed in tension, and, door means in said housing means for giving access to said sanding drum and said tension roller.

2. A dual mode floor sander as claimed in claim 1 wherein said tension roller comprises roller means movably mounted relative to said sanding drum, and spring means urging said tension roller away from said sanding drum, whereby to apply tension to a belt placed therearound.

3. A dual mode floor sander as claimed in claim 2 wherein said tension roller further comprises pressure means operable on said tension roller, whereby to force said tension roller against said spring means towards said sanding drum, thereby permitting removal and replacement of said sanding belt thereon.

4. A dual mode floor sander as claimed in claim 3 and wherein said tension roller further comprises a mounting frame for carrying said tension roller, downwardly dependant column means located centrally of said frame, a cantilever arm extending from one side of said housing means beneath said frame, sleeve at the end of said cantilever arm oriented to receive said column, slide means at the other end of said cantilever arm, whereby the same may be slid upwardly and downwardly relative to said housing means, and, spring means urging said cantilever arm upwardly, away from said sanding drum.

5. A dual mode floor sander as claimed in claim 4 wherein said pressure means comprise a cam member rotatably mounted adjacent said slide means, and an operating arm on the exterior of said housing means, for operating said cam, whereby pressure may be applied to said cantilever arm, to slide it downwardly towards said sanding drum.

6. A dual mode floor sander as claimed in claim 5, and further including belt guide means mounted on said frame means adjacent said tension roller, whereby to guide a belt passing therearound.

7. A dual mode floor sander as claimed in claim 1 and wherein said door means comprises a side door, and a side opening, closed by said side door, and a front door, and a front opening closed by said front door, said doors giving access, both to an end of said sanding drum and of said tension roller, and also giving access to the face of said sanding drum across its width.

8. A dual mode floor sander as claimed in claim 1, and further including a tension roller mounting bracket, having bearing supporting means at each end for supporting opposite ends of said tension roller, mounting abutment means intermediate said two ends of said bracket, mounting arm means engageable with said mounting abutment means, said mounting arm means defining a free end engageable with said abutment means, and said mounting arm further defining arm mounting means, whereby said arm may be movably mounted to an inside portion of said housing, whereby said mounting arm and said bracket means and said tension roller are together moveable relative to said sanding drum.

9. A dual mode floor sander as claimed in claim 8 and including rotatable belt guide members mounted on said bracket means at either end thereof, adjacent opposite ends of said tension roller, whereby to guide said belt passing over said tension roller.

10. A dual mode floor sander, as claimed in claim 1, wherein said movement means comprises a slidable support member, mounted to one side of said housing, and slidable along a linear path away from and towards said belt sander.

11. A dual mode floor sander, as claimed in claim 1, and wherein said mounting means includes an arm member, and bearings on opposite ends of said arm member and including at least one spring loaded bearing mounting means, and adjustment means therefore, whereby said tension roller may be tilted relative to said belt sander, for adjustment of a belt thereon.

12. A dual mode floor sander, as claimed in claim 11 and wherein said arm member is pivotally mounted to said side housing, and is both slidable towards and away from said sanding drum, and is further swingable relative thereto, whereby to procure tilting of said arm member and said tension roller relative to said sanding drum.

* * * * *